US009946179B2

(12) United States Patent
Arimura et al.

(10) Patent No.: US 9,946,179 B2
(45) Date of Patent: Apr. 17, 2018

(54) TONER

(71) Applicant: CANON KABUSHIKI KAISHA, Tokyo (JP)

(72) Inventors: Satoshi Arimura, Toride (JP); Yusuke Hasegawa, Suntou-gun (JP); Tomohisa Sano, Mishima (JP); Yoshitaka Suzumura, Mishima (JP); Takuma Ikejiri, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/362,992

(22) Filed: Nov. 29, 2016

(65) Prior Publication Data

US 2017/0160663 A1 Jun. 8, 2017

(30) Foreign Application Priority Data

Dec. 4, 2015 (JP) ..... 2015-237662

(51) Int. Cl.
*G03G 9/087* (2006.01)
*G03G 9/08* (2006.01)
*G03G 9/09* (2006.01)

(52) U.S. Cl.
CPC ..... *G03G 9/08755* (2013.01); *G03G 9/0819* (2013.01); *G03G 9/0825* (2013.01); (Continued)

(58) Field of Classification Search
CPC ..... G03G 9/08782; G03G 9/08755
See application file for complete search history.

(56) References Cited

U.S. PATENT DOCUMENTS 5,811,213 A * 9/1998 Chiba ..... G03G 9/08755 430/108.1
6,586,151 B1 7/2003 Naka et al.
(Continued)

FOREIGN PATENT DOCUMENTS

JP 2001-117262 4/2001
JP 2003-280245 10/2003
(Continued)

OTHER PUBLICATIONS

U.S. Appl. No. 15/256,780, Yusuke Hasegawa, filed Sep. 6, 2016.
(Continued)

*Primary Examiner* — Hoa V Le
(74) *Attorney, Agent, or Firm* — Fitzpatrick Cella Harper and Scinto

(57) ABSTRACT

A toner comprising a binder resin, a crystalline material, and a colorant, wherein, in a cross section image of the toner, when R (μm) is a long axis of the toner, r (μm) is a long axis of a crystalline material domain, domain A is a domain satisfying formula (ii), and domain B is a domain satisfying formula (iii), the toner in which the domain A and the domain B are both present is at least 50 number %; an number average diameter $R^{Avg}$ of the long axis of the toner satisfies formula (i); and a number of domain B per toner cross section of one toner is 20 to 300.

$$4\ \mu m \leq R^{Avg} \leq 12\ \mu m \quad \text{(i)}$$

$$0.125 \leq r/R \leq 0.375 \quad \text{(ii)}$$

$$0.000625 \leq r/R \leq 0.0625 \quad \text{(iii)}$$

5 Claims, 2 Drawing Sheets

(52) U.S. Cl.
CPC ..... *G03G 9/08711* (2013.01); *G03G 9/0902* (2013.01); *G03G 9/0926* (2013.01)

(56) References Cited

U.S. PATENT DOCUMENTS

| | | | | |
|---|---|---|---|---|
| 6,803,164 | B2 | 10/2004 | Mizoo et al. | |
| 6,953,646 | B2 | 10/2005 | Doujo et al. | |
| 7,123,862 | B2 | 10/2006 | Hasegawa et al. | |
| 7,160,660 | B2 | 1/2007 | Dojo et al. | |
| 7,344,812 | B2 | 3/2008 | Suzuki et al. | |
| 7,368,211 | B2 | 5/2008 | Hasegawa et al. | |
| 7,470,494 | B2 | 12/2008 | Nishiyama et al. | |
| 7,582,401 | B2 | 9/2009 | Ogawa et al. | |
| 7,678,523 | B2 | 3/2010 | Hiroko et al. | |
| 7,678,524 | B2 | 3/2010 | Hasegawa et al. | |
| 7,704,659 | B2 | 4/2010 | Ogawa et al. | |
| 7,745,085 | B2 | 6/2010 | Ishiyama et al. | |
| 7,811,734 | B2 | 10/2010 | Ogawa et al. | |
| 7,923,190 | B2 | 4/2011 | Magome et al. | |
| 7,935,467 | B2 | 5/2011 | Dojo et al. | |
| 7,939,231 | B2 | 5/2011 | Ogawa et al. | |
| 8,084,174 | B2 | 12/2011 | Hasegawa et al. | |
| 8,124,306 | B2 | 2/2012 | Hirata et al. | |
| 8,227,162 | B2 | 7/2012 | Sano et al. | |
| 8,426,091 | B2 | 4/2013 | Magome et al. | |
| 8,426,094 | B2 | 4/2013 | Magome et al. | |
| 8,518,620 | B2 | 8/2013 | Dojo et al. | |
| 8,614,044 | B2 | 12/2013 | Matsui et al. | |
| 8,778,585 | B2 | 7/2014 | Matsui et al. | |
| 8,841,054 | B2 | 9/2014 | Dojo et al. | |
| 8,918,035 | B2 | 12/2014 | Hasegawa et al. | |
| 9,029,055 | B2 | 5/2015 | Aoki et al. | |
| 9,097,997 | B2 | 8/2015 | Nomura et al. | |
| 9,152,065 | B2 | 10/2015 | Sano et al. | |
| 9,213,250 | B2 | 12/2015 | Nomura et al. | |
| 9,213,251 | B2 | 12/2015 | Ohmori et al. | |
| 9,217,943 | B2 | 12/2015 | Matsui et al. | |
| 9,235,151 | B2 | 1/2016 | Tanaka et al. | |
| 9,239,528 | B2 | 1/2016 | Hasegawa et al. | |
| 9,244,371 | B2 | 1/2016 | Suzumura et al. | |
| 9,377,708 | B2 | 6/2016 | Magome et al. | |
| 9,417,542 | B2 | 8/2016 | Hiroko et al. | |
| 9,423,710 | B2 | 8/2016 | Magome et al. | |
| 9,423,711 | B2 | 8/2016 | Uratani et al. | |
| 9,454,096 | B2 | 9/2016 | Hasegawa et al. | |
| 2009/0197192 | A1 | 8/2009 | Hiroko et al. | |
| 2012/0045717 | A1 | 2/2012 | Hiroko et al. | |
| 2013/0143154 | A1* | 6/2013 | Matsui | G03G 9/0806 430/109.3 |
| 2014/0335449 | A1* | 11/2014 | Uratani | G03G 9/0833 430/108.3 |
| 2015/0064617 | A1* | 3/2015 | Magome | G03G 9/08782 430/108.4 |
| 2015/0125790 | A1* | 5/2015 | Hotta | G03G 9/083 430/108.3 |
| 2015/0227067 | A1 | 8/2015 | Hasegawa et al. | |
| 2015/0227068 | A1 | 8/2015 | Sane et al. | |
| 2016/0041484 | A1* | 2/2016 | Tsuda | G03G 9/0839 430/108.6 |
| 2016/0139521 | A1 | 5/2016 | Tsuda et al. | |
| 2016/0154331 | A1 | 6/2016 | Tanaka et al. | |
| 2016/0266509 | A1 | 9/2016 | Sane et al. | |
| 2016/0378003 | A1 | 12/2016 | Arimura et al. | |
| 2017/0160660 | A1* | 6/2017 | Hasegawa | G03G 9/08782 |
| 2017/0160661 | A1* | 6/2017 | Suzumura | G03G 9/0821 |
| 2017/0160662 | A1* | 6/2017 | Nagashima | G03G 9/0833 |

FOREIGN PATENT DOCUMENTS

| | | |
|---|---|---|
| JP | 2006-084674 | 3/2006 |
| JP | 2008-033057 | 2/2008 |
| JP | 2011-145587 | 7/2011 |
| JP | 2015-121578 | 7/2015 |

OTHER PUBLICATIONS

U.S. Appl. No. 15/259,114, Yoshitaka Suzumura, filed Sep. 8, 2016.
U.S. Appl. No. 15/259,293, Yoshitaka Suzumura, filed Sep. 8, 2016.
U.S. Appl. No. 15/361,583, Yuujirou Nagashima, filed Nov. 28, 2016.
U.S. Appl. No. 15/366,295, Yoshitaka Suzumura, filed Dec. 1, 2016.

* cited by examiner

TONER

BACKGROUND OF THE INVENTION

Field of the Invention

The present invention relates to a toner that is used in, for example, electrophotographic methods, electrostatic recording methods, and magnetic recording methods.

Description of the Related Art

Image-forming apparatuses that use electrophotographic methods, e.g., copiers, printers, and so forth, have in recent years been subjected to increasing diversification with regard to their intended applications and their use environment, and along with this greater energy-saving capabilities are being required. As a consequence, higher speeds, higher image quality, and smaller sizes are being required and the apparatus process speed is continually increasing.

However, increases in the process speed cause the appearance of a problem known as a poor paper back end rubbing performance, which is a fixing defect that is produced—particularly when the fixing unit has not been fully warmed up during initial image output—in the absence of a complete heat transmission from the fixing unit to the media to the very last.

Viewed from the standpoint of using the toner to improve upon the poor paper back end rubbing performance, toner having an enhanced low-temperature fixability is considered first. Means for achieving this includes, for example, modifying the binder resin and modifying crystalline substances such as the wax.

Focusing here on the crystalline substance, e.g., the wax, it is generally known that the fixing performance can be enhanced by lowering the viscosity upon melting by using large amounts of the crystalline substance. However, a problem has been that the durability and/or storability readily deteriorate when a crystalline substance is used in large amounts, and these have thus resided in a trade-off relationship.

With regard to methods for enhancing the fixing performance, Japanese Patent Application Laid-open No. 2011-145587 discloses a toner that has an excellent low-temperature fixability achieved by regulating the area ratio between a crystalline polyester and a wax.

In addition, Japanese Patent Application Laid-open No. 2008-33057 discloses that the low-temperature fixability is enhanced by controlling the area ratio and state of contact between a crystalline polyester and a release agent. Japanese Patent Application Laid-open No. 2006-84674 discloses that the fixing performance is improved by regulating the particle size distribution and size of wax particles.

SUMMARY OF THE INVENTION

However, Japanese Patent Application Laid-open No. 2011-145587 does not adequately address the state of the crystalline material in the interior of the toner, and in particular there is room for additional improvements in the poor paper back end rubbing performance and the durability. Moreover, Japanese Patent Application Laid-open Nos. 2008-33057 and 2006-84674 do not adequately address the condition of the toner during long-term use and make no statement with regard to the durability being adequate.

An object of the present invention is to solve the problems identified above. Specifically, an object is to provide a toner that exhibits an excellent paper back end rubbing performance during initial image output and that provides, even during long-term use in a low-temperature, low-humidity environment, a stable image density and an excellent, fogging-free image.

The present invention relates to a toner containing a binder resin, a crystalline material, and a colorant, wherein, in a cross section image of the toner observed with a scanning transmission electron microscope, a domain of the crystalline material is present, when the domain satisfying the following formula (ii) is a domain A and the domain satisfying the following formula (iii) is a domain B, the toner in which the domain A and the domain B are both present is at least 50 number %, the toner satisfies the following formula (i), and the number of domain B per cross section image of one toner is at least 20 and not more than 300:

$$4\ \mu m \leq R^{Avg} \leq 12\ \mu m \quad \text{(i)}$$

$$0.125 \leq r/R \leq 0.375 \quad \text{(ii)}$$

$$0.000625 \leq r/R \leq 0.0625 \quad \text{(iii)}$$

in formulas (i) to (iii), $R^{Avg}$ represents the number average diameter of a long axis of the toner, R represents the long axis of the toner, r represents a long axis of the domain of the crystalline material.

Further features of the present invention will become apparent from the following description of exemplary embodiments (with reference to the attached drawings).

DESCRIPTION OF THE EMBODIMENTS

Figure 1:
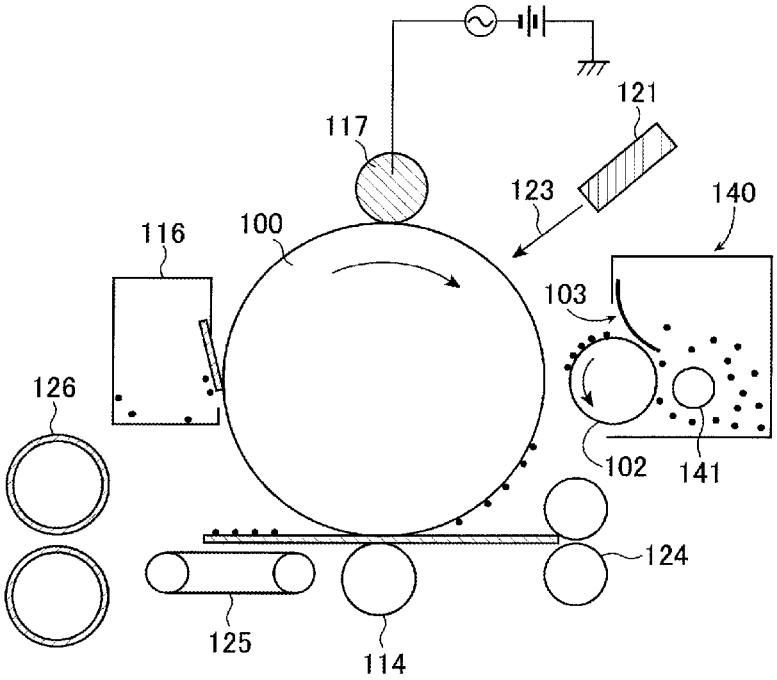
FIG. 1 is a schematic drawing that shows an example of an image-forming apparatus.

The present inventors discovered that the problems could be solved by controlling the state of the crystalline material in the toner and promoting crystallization and achieved the present invention based on this discovery. This is, the present invention is as follows:

a toner that contains a binder resin, a crystalline material, and a colorant, wherein, in a cross section image of the toner observed with a scanning transmission electron microscope (STEM), a domain of the crystalline material is present, when the domain satisfying the following formula (ii) is a domain A and the domain satisfying the following formula (iii) is a domain B, a ratio on the toner in which the domain A and the domain B are both present is at least 50 number % of the toner, the toner satisfies the following formula (i), and the number of domain B per cross section image of one toner is at least 20 and not more than 300:

$$4\ \mu m \leq R^{Avg} \leq 12\ \mu m \quad \text{(i)}$$

$$0.125 \leq r/R \leq 0.375 \quad \text{(ii)}$$

$$0.000625 \leq r/R \leq 0.0625 \quad \text{(iii)}$$

in formulas (i) to (iii), $R^{Avg}$ represents the number average diameter of a long axis of the toner, R represents the long axis of the toner, r represents a long axis of the domain of the crystalline material.

By using this toner, a toner can be provided that exhibits an excellent paper back end rubbing performance during initial image output and that provides a stable image density and an excellent, fogging-free image in particular even during long-term use in a low-temperature, low-humidity environment.

Observation of the crystalline material in the interior of the toner is performed by preparing a section of the toner and then staining the toner section with ruthenium tetroxide and performing observation using an STEM. The staining with ruthenium tetroxide produces a contrast difference in STEM observation between the crystalline material and amorphous resins, e.g., the binder resin. This makes it possible to readily differentiate and observe the crystalline material.

In addition, toner cross sections that exhibit a long axis R (μm) that satisfies the relationship $0.9 \leq R/D4 \leq 1.1$ with respect to the weight-average particle diameter (D4) of the toner are selected as the toner cross sections for observation.

The number average diameter $R^{Avg}$ of the toner long axis is at least 4 μm and not more than 12 μm and is preferably at least 5 μm and not more than 10 μm. The charge stability and fixing performance are improved by having the number average diameter of the long axis be in the indicated range. The long axis R can be controlled through, for example, the number of parts of the dispersion stabilizer and the rotation rate of the TK Homomixer.

Improving the paper back end rubbing performance during initial image output is considered first. During the initial image output, the temperature must be raised from the cold state of the fixing unit and the adjusted temperature swings above and below the intended temperature for the fixing unit and is prone to be unstable. In addition, as the process speed is raised, the amount of heat taken up by the media, e.g., paper, from the fixing unit also increases and in particular the amount of heat applied to the toner from the fixing unit readily declines at the back end of the paper. A toner that is rapidly plasticized by even less heat is required in order to improve the rubbing performance at the back end of the paper in particular when the adjusted temperature swings to its lower limit during initial image output.

Here, a better toner plasticity and thus an improvement in the rubbing performance is expected for an increase in the amount of addition of the crystalline material, e.g., wax. However, as the amount of addition of the crystalline material is increased, it more readily compatibilizes in the binder resin. Since as a general matter the crystalline material is a material that has a lower melting point and a lower molecular weight than the binder resin, its increasing compatibilization in the binder resin leads to embrittlement of the toner. A brittle toner is susceptible to cracking and chipping due to the stress arising from long-term use and its flowability declines. A trade-off relationship exists between this rubbing performance and the fogging.

In order to avoid causing the problem identified above, it is first of all essential, when observation of the toner cross section is carried out with a scanning transmission electron microscope, that a crystalline material domain A that satisfies $0.125 \leq r/R \leq 0.375$ (referred to below as the large domain) and a crystalline material domain B that satisfies $0.000625 \leq r/R \leq 0.0625$ (referred to below as the small domain) are present in the toner cross section and that the small domains are in the range of at least 20 and not more than 300.

Toner in which both the domain A and the domain B are present is at least 50 number % in the present invention. While the upper limit here is not particularly limited, a ratio of not more than 100 number % is preferred. The effects due to the presence of the large domain and small domain are readily obtained when this range is obeyed.

By having the large domain be in a somewhat large range, i.e., $0.125 \leq r/R \leq 0.375$, the toner as a whole that passes through the fixing unit can then be instantaneously collapsed by the heat and pressure and the low-temperature fixability is enhanced. When r/R for the domain A (large domain) is at least 0.125, a satisfactory plasticizing effect is obtained and the low-temperature fixability is enhanced. In addition, when it is not more than 0.375, the large domain accounts for a suitable amount of the toner as a whole and the durability is excellent as a consequence.

r/R for the large domain is preferably $0.225 \leq r/R \leq 0.3125$. The r/R of the large domain can be controlled using the amount of addition of the crystalline material, the cooling rate in step (i) described below, and the holding time in (a) and the residence time in (b) of step (ii) described below.

It is also essential that the number of small domains, for which $0.000625 \leq r/R \leq 0.0625$, be in the range of at least 20 and not more than 300. The specification that the number of small domains be in the indicated range means that the crystalline material is microfinely dispersed in the interior of the toner. By having the crystalline material be microfinely dispersed in the interior of the toner, the toner as a whole is rapidly plasticized by the application of heat and the low-temperature fixability is then enhanced. When r/R for the domain B (small domain) is at least 0.000625, a satisfactory plasticizing effect is obtained and the low-temperature fixing is then enhanced. In addition, when the r/R of the small domain is not more than 0.0625, the number of parts of addition of the crystalline material will be in a favorable range and this is advantageous for the durability.

r/R for the small domain is preferably $0.0125 \leq r/R \leq 0.0375$. The r/R of the small domain can be controlled through the holding time in (a) and the residence time in (b) of step (ii) described below.

Due to a synergistic effect arising from the presence of the large domains and small domains in the ranges indicated above, the toner as a whole instantaneously collapses and is rapidly plasticized and as a result the rubbing performance can be improved, even at the back end of the paper during initial image output, without increasing the amount of addition of the crystalline material. When in particular the large domains and small domains are domains derived from the same crystalline material composition, plasticization occurs at the same and the enhancing effect on the low-temperature fixability becomes even more substantial.

Domains for which the r/R size of the domain is $0.0625 < r/R < 0.125$, which do not correspond to a large domain or a small domain, do not exhibit a sufficient synergistic effect as do the small domain and large domain and due to this do not contribute to the effects of the present invention.

The number of such domains with $0.0625 < r/R < 0.125$ per cross section image of one toner is preferably at least 0 and not more than 30 and is more preferably at least 0 and not more than 10.

In addition, the number of domains with $r/R > 0.375$ is, per cross section image of one toner, preferably at least 0 and not more than 3 and is more preferably at least 0 and not more than 2.

The number of domains with r/R<0.000625 is, per cross section image of one toner, preferably at least 0 and not more than 50 and is more preferably at least 0 and not more than 30.

The generation of fogging after long-term use in a low-temperature, low-humidity environment will now be considered. Considering an apparatus that has a developing sleeve and a developing blade, the toner is charged by being subjected to rubbing between the blade and the sleeve. Turnover of the toner between the blade and sleeve is required in order for the toner to be adequately charged, and due to this the flowability of the toner is crucial. The flowability of toner subjected to stress due to long-term use assumes a declining trend due to, for example, cracking and chipping. Toner having a reduced flowability readily presents nonuniform charging particularly in a low-temperature, low-humidity environment and fogging is then produced in non-image areas. While the addition of the crystalline material does enhance the low-temperature fixability, the toner is embrittled as described above. However, the presence of the small domains in the range of at least 20 and not more than 300 means that the crystalline material is microfinely dispersed and the crystalline material then raises the toughness due to its function as a filler.

The small domains are preferably formed by bringing about the crystal growth of crystalline material compatibilized in the toner. By doing this, the crystalline material compatibilized in the toner can be reduced.

The trade off between the paper back end rubbing performance during initial image output and the fogging after long-term use can be abolished by controlling the state of the large domains and small domains as described in the preceding.

When there are fewer than 20 small domains, the plasticizing effect and filler effect cannot be obtained to a satisfactory degree for the toner as a whole and the low-temperature fixability and durability then decline. When there are more than 300 small domains, the number of parts of addition of the crystalline material is then large and the crystal growth is expected to be inadequate and as a consequence the suppression of toner embrittlement is inadequate and the durability declines.

The number of small domains is preferably at least 50 and not more than 250. The number of small domains can be controlled through the cooling rate in step (i) described below and the number of parts of addition of the crystalline material.

The crystalline material preferably contains an ester wax.

A more spherical shape is desirable for the structure of the small domain in order to obtain the toner embrittlement-suppressing filler effect to a satisfactory degree. As a result of intensive investigations, the present inventors discovered that the structure of the small domain is readily made spherical when the crystalline material is an ester wax. In this regard it is thought that a spherical shape is assumed due to the crystallization of the ester wax molecular chains in a folded form.

For this reason the aspect ratio of the small domain is preferably at least 0.8 and not more than 1.0 and is more preferably at least 0.9 and not more than 1.0. It is thought that an additional filler effect can be obtained by having the aspect ratio be at least 0.8.

An ester wax having a controlled composition distribution is more preferably used for the ester wax. Specifically, the ester wax preferably contains an ester compound and, in the composition distribution of the ester wax measured by GC-MASS or MALDI TOF MASS, the proportion of the highest-content ester compound relative to the total amount of the ester wax is preferably at least 40 mass % and not more than 80 mass %. This means that a composition distribution is present in the ester wax and that a certain degree of breadth is desirable. When this range is obtained, the compatibility with the binder resin is increased and the dispersing effect for the small domains is increased, making this preferred. At least 50 mass % and not more than 80 mass % is more preferred.

The ester wax is preferably a polyfunctional ester wax that has at least 2 and not more than 6 (more preferably at least 2 and not more than 3) ester bonds in its structure. The polyfunctional designation here indicates that at least 2 ester groups are present in the structure of 1 molecule of the ester wax. In addition, an ester compound from an at least dihydric alcohol and an aliphatic monocarboxylic acid and an ester compound from an at least dibasic carboxylic acid and an aliphatic monoalcohol are preferred for the polyfunctional ester wax. For example, the condensate of pentaerythritol with stearic acid is tetrafunctional because it has 4 ester groups in 1 molecule. An at least difunctional ester wax readily simultaneously satisfies the compatibility and structure necessary for use in the present invention and can thus be favorably used.

The above-described state of the large domains and small domains can be controlled, for example, using the steps (i) and (ii) described below. These steps (i) and (ii) are preferably carried out after toner particle production. For example, when the suspension polymerization method described below is used, steps (i) and (ii) are preferably performed after carrying out the polymerization reaction of the polymerizable monomer.

Step (i) is a step of subjecting an aqueous medium in which the toner particle is dispersed to cooling at a cooling rate of at least 5.00° C./minute, from a temperature that is higher than the temperature that is the higher of the crystallization temperature Tc (° C.) of the crystalline material and the glass transition temperature Tg (° C.) of the toner (i.e., a temperature higher than Tc (° C.) and Tg (° C.)), to a temperature that is not greater than this Tg (° C.).

An additional process of, e.g., heating the aqueous medium, is not required when, in the suspension polymerization method described below, the polymerization temperature in polymerization of the polymerizable monomer is a temperature (the cooling start temperature Tl) higher than the crystallization temperature Tc (° C.) of the crystalline material and the glass transition temperature Tg (° C.) of the toner in step (i). When, on the other hand, this polymerization temperature does not satisfy the cooling start temperature T1, the temperature of the aqueous medium is preferably raised.

In order in step (i) to adequately melt both the binder resin and the crystalline material, preferably a temperature is first maintained for at least 30 minutes and not more than 600 minutes such that the temperature of the aqueous medium satisfies a temperature higher than the crystallization temperature Tc (° C.) of the crystalline material and the glass transition temperature Tg (° C.) of the toner.

The temperature of the aqueous medium is then rapidly cooled at a cooling rate of at least 5.00° C./minute to a temperature that is not greater than the glass transition temperature Tg (° C.) of the toner. Here, the cooling start temperature T1 is a temperature that is an aqueous medium temperature that is higher than the crystallization temperature Tc (° C.) of the crystalline material and the glass transition temperature Tg (° C.) of the toner and is the temperature immediately before the rapid cooling. The cooling stop temperature T2 is the temperature of the aqueous medium at the completion of the rapid cooling process. The cooling rate 1 of the aqueous medium in step (i) is determined using the following formula.

$$\text{cooling rate 1}=(T1(^\circ\text{ C.})-T2(^\circ\text{ C.}))/\text{time required for cooling (minutes)}$$

The means for rapidly cooling the temperature of the aqueous medium can be exemplified by the use, for example, of an operation in which cold water and/or ice is mixed, an operation in which a cold air current is bubbled through the aqueous medium, and an operation in which heat is removed from the aqueous medium using a heat exchanger.

The state of the large domains and small domains can be favorably controlled in step (i) by the rapid cooling at a rate of at least 5.00° C./minute. When the cooling rate is less than 5.00° C./minute, a trend is assumed in step (ii), see below, whereby the amount of production of the crystalline material small domains declines. A preferred range for the cooling rate is at least 55.00° C./minute and a more preferred range is at least 95.00° C./minute. The upper limit is not particularly limited, but is preferably not more than 1,000° C./minute.

In the present invention, the crystallization temperature Tc (° C.) in step (i) preferably is a temperature that is at least 10° C. higher than the glass transition temperature Tg (° C.). In addition, this is preferably a step in which cooling is carried out at a cooling rate of at least 5.00° C./minute from a temperature that is 5° C. to 22° C. higher than the crystallization temperature Tc (° C.), to a temperature that is not greater than the Tg (° C.). When the cooling start temperature T1 is 5° C. to 22° C. higher than the crystallization temperature Tc (° C.), as described above, this facilitates control of the state of dispersion of the crystalline material in the toner particle and improves the fixing performance and durability.

The ensuing step (ii) is (a) a step of holding the aqueous dispersion that has gone through step (i) for at least 30 minutes in the temperature region of the glass transition temperature Tg of the toner ±10° C., or (b) a step of cooling the aqueous dispersion that has gone through step (i) such that it resides for at least 20 minutes at a temperature of the Tg of the toner ±10° C.

The generation of crystal nuclei of the crystalline material and an enhancement of the degree of crystallinity due to crystal growth are carried out in the interior of the toner particle in step (ii). Crystal nuclei generation and crystal growth proceed favorably in the indicated temperature region relative to the glass transition temperature Tg of the toner.

Crystal growth is carried out in (a) of step (ii) by holding the temperature of the aqueous medium constant at any temperature within the temperature region indicated above. In order to bring about adequate crystal growth, the time for holding the temperature of the aqueous medium is preferably at least 30 minutes. At least 90 minutes is more preferred and at least 120 minutes is still more preferred. The upper limit here, on the other hand, is not particularly limited, but is preferably not more than 600 minutes considering the productivity. When the cooling stop temperature T2 is lower than the temperature range indicated above, the aqueous medium may be reheated and the temperature may be held after the aqueous medium has been brought to the temperature range indicated above.

By holding at at least Tg−10° C., the binder resin does not undergo an excessive solidification and the compatibilized wax then readily forms small domains. By holding at not more than Tg+10° C., the binder resin undergoes an appropriate degree of solidification and the crystal growth becomes excellent and the fixing performance is improved. More preferred temperatures for holding the aqueous medium are the temperature region of Tg±5° C.

Designating the residence time as the time during which the temperature of the aqueous medium is in the temperature region indicated above, a satisfactory crystal growth is carried out in (b) of step (ii) by having this residence time be at least 20 minutes. A preferred range for the residence time is at least 40 minutes and a more preferred range is at least 100 minutes. The upper limit, on the other hand, is not particularly limited, but is preferably not more than 600 minutes considering the productivity. When the aqueous medium is brought into the range of the aforementioned temperature region a plurality of times by bringing the temperature of the aqueous medium to outside the range of the aforementioned temperature region and then heating or cooling the aqueous medium, the cumulative cooling time is the residence time. When the residence time is at least 20 minutes, crystal growth is satisfactory and the fixing performance and developing performance are excellent.

Using T3 for the cooling start temperature and Tg−10° C. for the cooling stop temperature in (b) of step (ii), the cooling rate 2 for (b) in step (ii) can be obtained from the following formula.

$$\text{cooling rate 2}=(T3(^\circ\text{ C.})-(Tg-10^\circ\text{ C.}))/\text{residence time (minutes)}$$

The ratio of the cooling rate 2 to the cooling rate 1 is preferably not more than 0.05. With this range, due to the formation in step (ii) of a very large number of crystal nuclei by the crystalline material compatibilized in the binder resin during the cooling in step (i), the amount of small domains undergoes an increase and the small domains undergo crystal growth. The fixing performance is excellent due to this, which is thus preferred. A more preferred range is not more than 0.02.

Preferred embodiments for the toner of the present invention are described in the following.

The toner particle according to the present invention contains a crystalline material. The content of the crystalline material in the toner particle is preferably at least 1 mass part and not more than 35 mass parts per 100 mass parts of the binder resin. A more preferred range is at least 3 mass parts and not more than 30 mass parts.

Known materials, e.g., waxes and crystalline polyesters, can be used for the crystalline material usable in the present invention, and as necessary a single species of crystalline material may be used or two or more species of crystalline materials may be used. The waxes that may be used can be exemplified by the following:

aliphatic hydrocarbon waxes such as low molecular weight polyethylene, low molecular weight polypropylene, microcrystalline wax, Fischer-Tropsch waxes, and paraffin waxes; oxides of aliphatic hydrocarbon waxes, such as oxidized polyethylene wax, and their block copolymers; waxes in which the major component is fatty acid ester, such as carnauba wax and montanic acid ester waxes, and waxes provided by the partial or complete deacidification of fatty acid esters, such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislaurarmide, and hexamethylenebisstearamride; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N, N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained, for example, by the hydrogenation of plant oils.

When a wax is used in the present invention, it is preferably an ester wax as described above. An ester wax is a crystalline wax that contains an ester compound having the ester bond. The content of the ester wax is preferably at least 1 mass part and not more than 35 mass parts per 100 mass parts of the binder resin.

The condensate of a $C_{6-12}$ aliphatic alcohol and a long-chain carboxylic acid and the condensate of a $C_{4-16}$ aliphatic carboxylic acid and a long-chain alcohol can be used as a monofunctional ester wax.

The aliphatic alcohol can be exemplified by 1-hexanol, 1-heptanol, 1-octanol, 1-nonanol, 1-decanol, undecyl alcohol, and lauryl alcohol. The aliphatic carboxylic acid can be exemplified by pentanoic acid, hexanoic acid, heptanoic acid, octanoic acid, nonanoic acid, and decanoic acid.

Ester compounds from a $C_{4-14}$ aliphatic dicarboxylic acid and a $C_{10-24}$ aliphatic monoalcohol and ester compounds from a $C_{2-12}$ aliphatic diol and a $C_{10-26}$ aliphatic monocarboxylic acid are preferred for difunctional ester waxes.

The dicarboxylic acids can be exemplified by adipic acid, pimelic acid, suberic acid, sebacic acid, azelaic acid, decanedioic acid, and dodecanedioic acid. The diol can be exemplified by 1,6-hexanediol, 1,7-heptanediol, 1,8-octanediol, 1, 9-nonanediol, 1,10-decanediol, 1,11-undecanediol, and 1,12-dodecanediol. Straight-chain fatty acids and straight-chain alcohols have been provided as examples here, but branched structures may also be present. Among the preceding, 1,6-hexanediol, 1,9-nonanediol, 1,10-decanediol, and 1,12-dodecanediol are preferred, while 1,9-nonanediol and 1,10-decanediol are preferred for their ability to readily accomplish the effects of the present invention.

The alcohol for condensation with the dicarboxylic acid is preferably an aliphatic monoalcohol. Specific examples are tetradecanol, pentadecanol, hexadecanol, heptadecanol, octadecanol, nonadecanol, eicosanol, docosanol, tricosanol, tetracosanol, pentacosanol, hexacosanol, and octacosanol. Docosanol is preferred among the preceding from the standpoint of the fixing performance and the developing performance.

The carboxylic acid for condensation with the diol is preferably an aliphatic monocarboxylic acid. Specific examples are fatty acids such as lauric acid, myristic acid, palmitic acid, margaric acid, stearic acid, tuberculostearic acid, arachidic acid, behenic acid, lignoceric acid, and cerotic acid. Behenic acid is preferred among the preceding from the standpoint of the fixing performance and the developing performance.

Trifunctional ester waxes can be exemplified by condensates between a glycerol compound and an aliphatic monocarboxylic acid. Tetrafunctional ester waxes can be exemplified by condensates between pentaerythritol and an aliphatic monocarboxylic acid and condensates between diglycerol and a monocarboxylic acid. Pentafunctional ester waxes can be exemplified by condensates between triglycerol and an aliphatic monocarboxylic acid. Hexafunctional ester waxes can be exemplified by condensates between dipentaerythritol and an aliphatic monocarboxylic acid and condensates between tetraglycerol and an aliphatic monocarboxylic acid.

Crystalline polyesters that can be used in the present invention are described in the following.

Known crystalline polyesters can be used in the present invention, but polyesters produced from a straight-chain aliphatic dicarboxylic acid given by formula (1) below and a straight-chain aliphatic diol given by formula (2) below are preferred.

$$HOOC—(CH_2)_m—COOH \quad \text{formula (1)}$$

[m in the formula represents an integer from 4 to 14]

$$HO—(CH_2)_n—OH \quad \text{formula (2)}$$

[n in the formula represents an integer from 4 to 16]

Straight-chain polyesters produced from a dicarboxylic acid with formula (1) and a diol with formula (2) exhibit an excellent crystallinity and readily form domains. When m in formula (1) and n in formula (2) are at least 4, the melting point (Tm) is in a range suitable for fixing the toner and as a consequence the low-temperature fixability is excellent. When m in formula (1) is not more than 14 and n in formula (2) is not more than 16, the materials are then readily acquired in practice.

As necessary, a monobasic acid, e.g., acetic acid or benzoic acid, and/or a monohydric alcohol, e.g., cyclohexanol or benzyl alcohol, may also be used with the goal, inter alia, of adjusting the acid value or hydroxyl value.

The crystalline polyester can be produced by common methods for synthesizing polyesters. For example, the crystalline polyester can be obtained by carrying out an esterification reaction or a transesterification reaction between a dicarboxylic acid component and a dialcohol component followed by running a polycondensation reaction according to a common method under reduced pressure or with the introduction of nitrogen gas.

A common esterification catalyst or transesterification catalyst, e.g., sulfuric acid, tertiary-butyl titanium butoxide, dibutyltin oxide, manganese acetate, magnesium acetate, and so forth, can as necessary be used in the esterification or transesterification reaction. A common polymerization catalyst, for example, a known polymerization catalyst, e.g., tertiary-butyl titanium butoxide, dibutyltin oxide, tin acetate, zinc acetate, tin disulfide, antimony trioxide, and germanium dioxide, can be used for the polymerization. There are no particular limitations on the polymerization temperature and the amount of catalyst, and these may be freely selected as necessary.

A titanium catalyst is desirably used as the catalyst here, and a chelate-type titanium catalyst is more desirable. The reasons for this are that titanium catalysts have a favorable reactivity and provide polyester having a desirable molecular weight distribution for the present invention.

In addition, the acid value of the crystalline polyester can be controlled by capping the carboxyl group present at the polymer ends. A monocarboxylic acid or monoalcohol can be used for end capping. The monocarboxylic acid can be exemplified by benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid. Methanol, ethanol, propanol, isopropanol, butanol, and higher alcohols can be used as the monoalcohol.

The following can be used as the binder resin used in the toner of the present invention: homopolymers of styrene and substituted styrenes, e.g., polystyrene and polyvinyltoluene, as well as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl, ketone copolymer, styrene-butadiene copolymer, styrene-isoprene copolymer, and styrene-maleic acid copolymer. A single one of these may be used by itself or a plurality may be used in combination.

Styrene-acrylic resins are preferred among the preceding, e.g., styrene-ethyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer.

The glass transition temperature Tg of the binder resin is preferably at least 47° C. and not more than 65° C. in the present invention. A glass transition temperature Tg in this range is preferred because this facilitates a satisfactory crystallization of the crystalline material.

The colorant used in the present invention can be exemplified by the following organic pigments, organic dyes, and inorganic pigments.

Cyan colorants can be exemplified by copper phthalocyanine compounds and derivatives thereof, anthraquinone compounds, and basic dye lake compounds. The following are specific examples: C.I. Pigment Blue 1, 7, 15, 15:1, 15:2, 15:3, 15:4, 60, 62, and 66.

Magenta colorants can be exemplified by the following: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are as follows: C.I. Pigment Red 2, 3, 5, 6, 7, 23, 48:2, 48:3, 48:4, 57:1, 81:1, 122, 144, 146, 150, 166, 169, 177, 1.84, 185, 202, 206, 220, 221, and 254 and C.I. Pigment Violet 19.

Yellow colorants can be exemplified by condensed azo compounds, isoindolinone compounds, anthraquinone compounds, azo-metal complexes, methine compounds, and allylamide compounds. Specific examples are as follows: C.I. Pigment Yellow 12, 13, 14, 15, 17, 62, 74, 83, 93, 94, 95, 97, 109, 11.0, 111, 120, 127, 128, 129, 147, 151, 154, 155, 168, 174, 175, 176, 180, 181, 185, 191, and 194.

Black colorants can be exemplified by carbon black and by black colorants provided by color mixing to yield black using a magnetic powder and the aforementioned yellow colorants, magenta colorants, and cyan colorants.

A single one or a mixture of these colorants may be used, and the colorant can be used in the form of a solid solution. The colorant used in the present invention is selected considering the hue angle, chroma, lightness, lightfastness, OHP transparency, and dispersibility in the toner particle.

In the case of use of a magnetic powder in the toner of the present invention, this magnetic powder is a magnetic powder that has as its major component a magnetic iron oxide such as iron(II,III) oxide or γ-ferric oxide and that may contain an element such as phosphorus, cobalt, nickel, copper, magnesium, manganese, aluminum, silicon, and so forth. The BET specific surface area of the magnetic powder by the nitrogen adsorption method is preferably 2 $m^2/g$ to 30 $m^2/g$ and is more preferably 3 $m^2/g$ to 28 $m^2/g$. The Mohs hardness is preferably 5 to 7. The shape of the magnetic powder is, for example, polyhedral, octahedral, hexahedral, spherical, acicular, or scale shape, and a low-anisotropy shape, e.g., polyhedral, octahedral, hexahedral, spherical, and so forth, is preferred from the standpoint of increasing the image density.

The magnetic powder preferably has a number-average particle diameter of 0.10 μm to 0.40 μm. Generally, a smaller particle diameter for the magnetic powder raises the tinting strength, but the indicated range is preferred from the standpoint of magnetic powder aggregation. When the number-average particle diameter is at least 0.10 μm, the magnetic powder itself is resistant to taking on a reddish black and as a consequence a reddish tinge is not conspicuous in particular in the halftone image and a high-quality image is then obtained. When, on the other hand, the number-average particle diameter is not more than 0.40 μm, the toner has an excellent tinting strength and a homogeneous dispersion is readily achieved in the suspension polymerization method (see below).

The number-average particle diameter of the magnetic powder can be measured using a transmission electron microscope. Specifically, the toner particles to be observed are thoroughly dispersed in an epoxy resin and curing is carried out for 2 days in an atmosphere with a temperature of 40° C. to obtain a cured material. A thin-section sample is prepared from the obtained cured material using a microtome and the diameter of 100 magnetic powder particles in the field of observation is measured on a photograph at a magnification of 10,000× to 40,000× using a transmission electron microscope (TEM). The number-average particle diameter is calculated based on the equivalent diameter of the circle that is equal to the projected area of the magnetic powder. The particle diameter can also be measured using an image analyzer.

The magnetic powder can be produced, for example, using the following method. An aqueous solution containing ferrous hydroxide is prepared by adding an equivalent or more—with respect to the iron component—of an alkali, e.g., sodium hydroxide, to an aqueous ferrous salt solution. A seed crystal, which will form the core of the magnetic iron oxide powder, is first produced by bubbling in air while maintaining the pH of the prepared aqueous solution at pH 7 or more and carrying out an oxidation reaction of the ferrous hydroxide while heating the aqueous solution to at least 70° C.

Then, an aqueous solution that contains approximately 1 equivalent of ferrous sulfate with reference to the amount of addition of the previously added alkali, is added to the slurry that contains the seed crystal. The reaction of the ferrous hydroxide is developed while maintaining the pH of the solution at 5 to 10 and bubbling in air in order to grow a magnetic iron oxide powder using the seed crystals as a core. The shape and magnetic properties of the magnetic powder can be controlled here by selection of the pH, reaction temperature, and stirring conditions as desired. While the pH of the solution transitions into the acid range as the oxidation reaction develops, the pH of the solution preferably does not fall below 5. The magnetic body obtained in the described manner is filtered, washed, and dried by conventional methods to yield a magnetic powder.

In addition, the surface of the magnetic powder is preferably subjected to a hydrophobic treatment when the toner will be produced in an aqueous medium in the present invention. In the case of surface treatment using a dry method, treatment with a coupling agent is carried out on a magnetic powder that has been washed, filtered, and dried. In the case of surface treatment using a wet method, the magnetic powder is dried after completion of the oxidation reaction and is then redispersed and subjected to the coupling treatment, or the iron oxide obtained by washing and filtration after the completion of the oxidation reaction is redispersed, without drying, in a separate aqueous medium and is then subjected to the coupling treatment. Either method, i.e., wet or dry, can be selected for the present invention as appropriate.

The coupling agent that can be used for surface treatment of the magnetic powder can be, for example, a silane coupling agent, titanium coupling agent, silane compound, and so forth. The use is more preferred of a silane coupling agent or silane compound as given by general formula (I).

$$R_mSiY_n \quad (I)$$

[In the formula, R represents an alkoxy group; m represents an integer from 1 to 3; Y represents a functional group, e.g., an alkyl group, a phenyl group, a vinyl group, an epoxy group, an acryl group, a methacryl group, and so forth; n represents an integer from 1 to 3; and m+n=4.]

The silane coupling agents and silane compounds given by general formula (I) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane.

The use is preferred in the present invention of general formula (I) in which Y is an alkyl group. An alkyl group having at least 3 and not more than 6 carbons is more preferred, and 3 or 4 carbons is particularly preferred.

When the silane coupling agent as described above is used, treatment may be carried out using a single one or treatment may be carried out using a plurality of silane coupling agents in combination. When a plurality of silane coupling agents are used, treatment may be carried out using each coupling agent separately or a simultaneous treatment may be carried out.

The overall amount of treatment with the coupling agent used is preferably 0.9 to 3.0 mass parts per 100 mass parts of the magnetic powder. It is important to adjust the amount of the treatment agent in correspondence to, for example, the surface area of the magnetic powder and the reactivity of the coupling agent.

An additional colorant other than the magnetic powder may be co-used therewith in the present invention. Co-usable colorants can be exemplified by the known dyes and pigments indicated above and also by magnetic inorganic compounds and nonmagnetic inorganic compounds. Specific examples are strongly magnetic metal particles of, e.g., cobalt, nickel, and so forth; alloys provided by the addition thereto of chromium, manganese, copper, zinc, aluminum, a rare earth element, and so forth; particles of hematite or the like; titanium black; nigrosine dyes/pigments; carbon black; and phthalocyanine. These also are preferably used after surface treatment.

The content of the magnetic powder in the toner can be measured using a TGA7 thermal analyzer from PerkinElmer Co., Ltd. The measurement method is as follows. The toner is heated from normal temperature to 900° C. at a ramp rate of 25° C./minute under a nitrogen atmosphere. The amount of the binder resin is taken to be the mass loss between 100° C. and 750° C., and the residual mass is taken to be approximately the amount of the magnetic powder.

The amount of colorant addition is preferably at least 1 mass part and not more than 20 mass parts per 100 mass parts of the binder resin. When a magnetic powder is used, it is preferably at least 20 mass parts and not more than 200 mass parts and more preferably at least 40 mass parts and not more than 150 mass parts, in each case per 100 mass parts of the binder resin or the polymerizable monomer that will constitute the binder resin.

A charge control agent may be used in order to keep the charging behavior of the toner stable regardless of the environment.

Negative-charging charge control agents can be exemplified by the following: monoazo metal compounds; acetylacetone metal compounds; metal compounds of aromatic oxycarboxylic acids, aromatic dicarboxylic acids, oxycarboxylic acids, and dicarboxylic acids; aromatic oxycarboxylic acids and aromatic mono- and polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium sales; calixarene; and resin-based charge control agents.

The positive-charging charge control agents can be exemplified by the following: nigrosine and nigrosine modifications by, for example, a fatty acid metal salt; guanidine compounds; imidazole compounds; quaternary ammonium salts such as tributylbenzylammonium 1-hydroxy-4-naphtholsulfonate salt and tetrabutylammonium tetrafluoroborate, and the onium salts, such as phosphonium salts, that are analogues of the preceding, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-based charge control agents.

A single one of the preceding may be used or combinations of two or more may be used.

Among the preceding, metal-containing salicylic acid compounds are preferred as charge control agents other than the resin-based charge control agents, and metal-containing salicylic acid compounds in which the metal is aluminum or zirconium are more preferred. Aluminum salicylate compounds are even more preferred control agents.

A polymer or copolymer that has a sulfonic acid group, sulfonate salt group, or sulfonate ester group, a salicylic acid segment, or a benzoic acid segment is preferably used for the resin-based charge control agent. The content of the charge control agent, per 100.0 mass parts of the binder resin, is preferably at least 0.01 mass parts and not more than 20.0 mass parts and is more preferably at least 0.05 mass parts and not more than 10.0 mass parts.

The weight-average particle diameter (D4) of the toner is preferably at least 3.0 μm and not more than 12.0 μm and is more preferably at least 4.0 μm and not more than 10.0 μm. When the weight-average particle diameter (D4) is at least 3.0 μm and not more than 12.0 μm, an excellent flowability is obtained and the latent image can be faithfully developed.

Any known method can be used to produce the toner particle, but insertion of the specific treatment steps described above, i.e., step (i) and step (ii), is more preferred for obtaining the effects of the present invention.

First, when production is carried out using a pulverization method, for example, the binder resin, colorant, crystalline material, and optional additives, e.g., a charge control agent, are thoroughly mixed using a mixer such as a Henschel mixer or a ball mill. This is followed by dispersing or melting the toner starting materials by melt kneading using a heated kneader, e.g., a hot roll, kneader, or extruder, and the toner particle is then obtained by proceeding through cooling and solidification, pulverization, then classification, and optionally a surface treatment. Either of the classification step and surface treatment step may precede the other in the sequence. Viewed in terms of the production efficiency, a multi-grade classifier is preferably used in the classification step.

The pulverization step can be carried out with a method that uses a known pulverization apparatus, e.g., a mechanical impact type, a jet type, and so forth. In addition, pulverization preferably is carried out with the additional application of heat and/or a process is preferably carried out in which a supplemental mechanical impact is applied. Moreover, for example, a hot water bath method may be used in which the finely pulverized (and optionally classified) toner particles are dispersed in hot water and/or a method may be used in which they are passed through a hot gas current.

The means for the application of a mechanical impact force can be exemplified by a method that uses a mechanical impact-type pulverizing apparatus such as a Kryptron System from Kawasaki Heavy Industries, Ltd. or a Turbomill from Turbo Kogyo Co., Ltd. Another example is a method in which the toner is pressed by centrifugal force to the inside of a casing using blades rotating at high speed, as in devices such as the Mechanofusion System from Hosokawa Micron Corporation and the Hybridization System from Nara Machinery Co., Ltd., to apply a mechanical impact force to the toner by forces such as compressive forces, frictional forces, and so forth.

When the toner particle is produced by a dry method such as a pulverization step, in order to obtain the effects of the present invention, preferably an aqueous dispersion is obtained by introducing the toner particle into water in which a dispersing agent is dispersed, followed by the execution of specific treatment steps, e.g., the aforementioned step (i) and step (ii).

Production methods that provide the toner particle by a suspension polymerization method or an emulsion aggregation method are preferred production methods for the present invention, with the suspension polymerization method being more preferred. The suspension polymerization method is a production method that facilitates the crystalline material forming a core structure and, because the toner particle is produced in an aqueous medium in the suspension polymerization method, a cooling step is then easily incorporated in the production process. Moreover, by bringing about a temporary compatibilization of the crystalline material in the binder, the effects of the cooling step can be thoroughly developed, and this is also advantageous for achieving a uniform and microfine dispersion of the small domains. The suspension polymerization method can provide a toner with a high circularity and a sharp particle size distribution. The effects of the present invention can be further enhanced as a result.

The suspension polymerization method is described in the following.

In the suspension polymerization method, the polymerizable monomer that will constitute the binder resin, the colorant, and the crystalline material (optionally also a polymerization initiator, crosslinking agent, charge control agent, and other additives) are dissolved or dispersed to uniformity to obtain a polymerizable monomer composition. This polymerizable monomer composition is then dispersed and granulated, using a suitable stirrer, in a continuous phase (for example, an aqueous phase) that contains a dispersing agent. A polymerization reaction is run on the polymerizable monomer present in the resulting particles (polymerization step) to obtain toner particles having a desired particle diameter. An improved image quality can be expected for the toner obtained by this suspension polymerization method (also referred to hereafter as "polymerized toner") since the individual toner particles uniformly have an approximately spherical shape and since the distribution in the amount of charge is then also made relatively uniform.

The polymerizable monomer used in the polymerizable monomer composition in the production of polymerized toner can be exemplified as follows.

The polymerizable monomer can be exemplified by styrenic monomers such as styrene, o-methylstyrene, m-methylstyrene, p-methylstyrene, p-methoxystyrene, and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and also monomers such as acrylonitrile, methacrylonitrile, and acrylamide. A single one or a mixture of these monomers may be used. Among these monomers, the use of styrene by itself or mixed with additional monomer is preferred from the standpoint of the durability and developing characteristics of the toner.

The polymerization initiator used in toner production by a polymerization method preferably has a half-life of 0.5 to 30 hours in the polymerization reaction. In addition, when the polymerization reaction is run using an amount of addition of 0.5 to 20 mass parts per 100 mass parts of the polymerizable monomer, a polymer can then be obtained that has a maximum between molecular weights of 5,000 and 50,000 and a desirable strength and suitable melt properties can be imparted to the toner.

Examples of specific polymerization initiators are azo or diazo polymerization initiators, e.g., 2,2'-azobis(2, 4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile, and peroxide polymerization initiators, e.g., benzoyl peroxide, methyl ethyl ketone peroxide, diisopropyl peroxycarbonate, cur ene hydroperoxide, 2,4-dichlorobenzoyl peroxide, lauroyl peroxide, t-butyl peroxy-2-ethylhexanoate, and t-butyl peroxypivalate.

A crosslinking agent may be added in toner production by a polymerization method, and the preferred amount of addition is at least 0.1 mass parts and not more than 10.0 mass parts per 100 mass parts of the polymerizable monomer.

Mainly compounds having at least two polymerizable double bonds are used as the crosslinking agent here, and, for example, a single selection or a mixture of two or more selections from the following may be used: aromatic divinyl compounds such as divinylbenzene and divinylnaphthalene; carboxylate esters having two double bonds, such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds that have three or more vinyl groups.

In the method of producing the toner of the present invention by a polymerization method, the polymerizable monomer composition—generally prepared by the suitable addition of the above-described toner composition and so forth and dispersion or dissolution to uniformity with a disperser such as, for example, a homogenizer, ball mill, or ultrasound disperser—is suspended in an aqueous medium containing a dispersing agent. The particle diameter of the obtained toner particle can be sharpened at this point by instantaneously providing the desired toner particle size using a high-speed disperser such as a high-speed stirrer or an ultrasound disperser. With regard to the timing of the addition of the polymerization initiator, it may be added at the same time as the addition of other additives to the polymerizable monomer or may be mixed immediately before suspension in the aqueous medium. In addition, the polymerization initiator may also be added, dissolved in the polymerizable monomer or a solvent, directly after granulation and prior to the start of the polymerization reaction.

After granulation, stirring using an ordinary stirrer is preferably carried out to a degree that maintains the particulate state and prevents the particles from floating or settling.

A known surfactant, organic dispersing agent, or poorly water-soluble inorganic dispersing agent can be used as the dispersing agent in the production of the toner of the present invention. Among these, the use of poorly water-soluble inorganic dispersing agents is preferred because they inhibit the production of toxic ultrafine dust; they achieve dispersion stability through steric hindrance and because of this resist disruptions in the stability even when changes in the reaction temperature occur; and they are also easily washed out and thus tend to avoid having negative effects on the toner. In addition, the poorly water-soluble inorganic dispersing agents have a high polarity and readily inhibit deposition of the hydrophobic crystalline material on the toner particle surface and are thus strongly preferred.

These inorganic dispersing agents can be exemplified by multivalent metal salts of phosphoric acid, such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

These inorganic dispersing agents are desirably used at least 0.2 mass parts and not more than 20.0 mass parts per 100 mass parts of the polymerizable monomer.

When these inorganic dispersing agents are used, they may be used as such or, in order to obtain even finer particles, they may be used by producing particles of the inorganic dispersing agent in the aqueous medium. For example, in the case of tricalcium phosphate, water-insoluble calcium phosphate can be produced by mixing an aqueous sodium phosphate solution with an aqueous calcium chloride solution under high-speed stirring, and a more uniform fine dispersion is then made possible. Here, water-soluble sodium chloride is produced as a by-product at the same time, but the presence of the water-soluble salt in the aqueous medium is even more favorable because this inhibits the dissolution of the polymerizable monomer in the water and suppresses the production of ultrafine toner particles by emulsion polymerization.

The surfactant can be exemplified by sodium dodecylbenzene sulfate, sodium tetradecyl sulfate, sodium pentadecyl sulfate, sodium octyl sulfate, sodium oleate, sodium laurate, sodium stearate, and potassium stearate.

The polymerization temperature in the step of polymerizing the polymerizable monomer is generally set to at least 40° C. and preferably to a temperature from 50° C. to 100° C.

A toner can be prepared optionally by mixing an additive, e.g., a fluidizing agent, with the toner particle obtained by the production method described in the preceding. A known procedure can be used for the mixing method, for example, a Henschel mixer is an apparatus that can be favorably used.

An inorganic fine powder having a number-average primary particle diameter of 4 nm to 80 nm and more preferably 6 nm to 40 nm is preferably added to the toner particle in the present invention as a fluidizing agent. The inorganic fine powder is added in order to improve toner flowability and provide uniform charging of the toner particle, but in a preferred embodiment functionalities such as adjusting the amount of toner charge, improving the environmental stability, and so forth are also imparted by a treatment of the inorganic fine powder such as a hydrophobic treatment. Measurement of the number-average primary particle diameter of the inorganic fine powder is carried out using a photograph of the toner enlarged using a scanning electron microscope.

For example, silica, titanium oxide, and alumina can be used as the inorganic fine powder. Either a so-called dry silica known as dry-method or fumed silica, and produced by the vapor-phase oxidation of a silicon halide, or a so-called wet silica produced from, for example, water glass, can be used as the silica fine powder. However, dry silica, which has little silanol group at the surface or within the silica fine powder and which has little residual $Na_2O$, $SO_3^{2-}$, and so forth from production, is preferred. Moreover, in the case of dry silica, a composite fine powder of silica and another metal oxide can also be obtained by the use in the production process of another metal halide compound, for example, aluminum chloride, titanium chloride, and so forth, along with the silicon halide compound, and this is also encompassed by dry silica.

The amount of addition of the inorganic fine powder is preferably at least 0.1 mass parts and not more than 3.0 mass parts per 100 mass parts of the toner particle. The effects from the inorganic fine powder are satisfactorily obtained when its amount of addition is at least 0.1 mass parts, while the fixing performance is excellent at not more than 3.0 mass parts. The content of the inorganic fine powder can be quantitatively determined using fluorescent X-ray analysis and using a calibration curve constructed from reference samples.

The inorganic fine powder in the present invention is preferably a material that has been subjected to a hydrophobic treatment because this can improve the environmental stability of the toner. When the inorganic fine powder added to the toner is hygroscopic, the amount of charge on the toner particle undergoes a substantial decline, the amount of charge is prone to become nonuniform, and toner scattering readily occurs. A single one of the following treatment agents or a combination of two or more can be used as the treatment agent used for the hydrophobic treatment of the inorganic fine powder: silicone varnishes, variously modified silicone varnishes, silicone oils, variously modified silicone oils, silane compounds, silane coupling agents, organosilicon compounds other than the preceding, organotitanium compounds, and so forth.

Other additives can also be used in small amounts in the toner of the present invention as developing performance-improving agents within a range that does not cause substantial negative effects, for example, lubricant powders such as fluororesin powders, zinc stearate powders, and polyvinylidene fluoride powders; abrasives such as cerium oxide powder, silicon carbide powder, and strontium titanate powder; fluidity-imparting agents such as titanium oxide powder and aluminum oxide powder; anti-caking agents; and reverse-polarity organic fine particles and inorganic fine particles. These additives may also be used after a surface hydrophobic treatment.

An example of an image-forming apparatus that can advantageously use the toner of the present invention is specifically described in the following with reference to FIG. 1. In FIG. 1, 100 is a photosensitive member, and, for example, the following are disposed on its circumference: a charging roller 117, a developing device 140 having a toner-carrying member 102, a transfer charging roller 114, a cleaner 116, and a register roller 124. The photosensitive member 100 is charged to, for example, −600 V (the applied voltage is, for example, an AC voltage of 1.85 kVpp or a DC voltage of −620 Vdc), by the primary charging roller 117. Photoexposure is carried out by irradiating the photosensitive member 100 with laser light 123 from a laser generator 121, and an electrostatic latent image that corresponds to the target image is thereby formed. The electrostatic latent image on the photosensitive member 100 is developed by a single-component toner by the developing device 140 to obtain a toner image, and the toner image is transferred onto a transfer material by the transfer charging roller 114, which contacts the photosensitive member with the transfer material interposed therebetween. The transfer material bearing the toner image is moved to the fixing unit 126 by, for example, the transport belt 125, and fixing onto the transfer material is carried out. In addition, the toner remaining in part on the photosensitive member is cleaned off by the cleaner 116.

An image-forming apparatus that uses magnetic single-component jumping development is illustrated here, but this may be an image-forming apparatus used in either a jumping development method or a contact development method.

The methods for measuring the individual properties pertaining to the toner of the present invention are described in the following.

<Method for Measuring the Weight-Average Particle Diameter (D4) of the Toner (Particle)>

The weight-average particle diameter (D4) of the toner (particle) is determined using a "Coulter Counter Multisizer 3" (registered trademark, from Beckman Coulter, Inc.), a precision particle size distribution measurement instrument operating or, the pore electrical resistance method and equipped with a 100 μm aperture tube; using the accompanying dedicated software, i.e., "Beckman Coulter Multisizer 3 Version 3.51" (from Beckman Coulter, Inc.) to set the measurement conditions and perform analysis of the measurement data; and performing the measurements in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the threshold value/noise level measurement button. In addition, the current is set to 1,600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) Deionized water is introduced in a prescribed amount into the water tank of an "Ultrasonic Dispersion System Tetora 150" (from Nikkaki Bios Co., Ltd.), which is art ultrasound disperser with an electrical output of 120 W and is equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner (particle) is added to the aqueous electrolyte solution in small portions and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the aqueous electrolyte solution prepared in (5) containing the dispersed toner (particle) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Measurement of the Molecular Weight and Composition Distribution of the Ester Wax>

The composition distribution of the ester, wax is obtained by first measuring the molecular weight distribution by GPC and then measuring this region by gas chromatography (GC) or MALDI TOW MASS. The GPC of the ester wax is measured under the following conditions.

(GPC Measurement Conditions)

column: 2×GMH-HT30 cm (from Tosoh Corporation)
temperature: 135° C.
solvent: o-dichlorobenzene (0.1% Ionol added)
flow rate: 1.0 mL/minute
sample: injection of 0.4 mL of the 0.15% sample A molecular weight calibration curve constructed using monodisperse polystyrene standard samples is used for the determination of the sample molecular weight measured under the conditions given above. Moreover, calculation as polyethylene is performed using a conversion formula derived from the Mark-Houwink viscosity equation.

The peaks yielded by GPC are analyzed and the maximum value and minimum value of the molecular weight distribution for the ester wax are calculated. During the analysis by GC and MALDI TOF MASS as described below, the region sandwiched between the maximum value and minimum value yielded by GPC is regarded as the "range of the molecular weight distribution of the ester wax". While the ester wax of the present invention can be measured by either GC or MALDI TOF MASS, MALDI is suitably selected when volatilization is problematic and GC is suitably selected when a peak overlaps with the matrix. Both measurement methods are described.

(GC Measurement Conditions)

The specific conditions for measuring, by gas chromatography (GC), the composition distribution of the ester wax are described here. A GC-17A (from Shimadzu Corporation) is used for the gas chromatography (GC). 10 mg of the sample is added to 1 mL of toluene and heating and dissolution are carried out for 20 minutes in an 80° C. thermostat. 1 μL of this solution is then injected into the GC instrument equipped with an on-column injector. The column used is a 0.5 mm diameter×10 m length Ultra Alloy-1 (HT). The column is initially heated from 40° C. to 200° C. at a ramp speed of 40° C./minute; is then heated to 350° C. at 15° C./minute; and is then heated to 450° C. at a ramp speed of 7° C./minute. He gas is supplied as the carrier gas at a pressure condition of 50 kPa.

The peak group contained in the aforementioned "range of the molecular weight distribution of the ester wax" is elucidated by introducing the volatilized component into a mass spectrometer (mass analyzer) and obtaining the molecular weights of the multiple peaks provided by GC. This peak group is analyzed and the sum of the peak areas is calculated. In addition, the peak having the largest peak area of the peaks obtained by GC is designated as the peak originating with the highest-content ester compound, and the proportion of this highest-content ester compound in the composition distribution of the ester wax is obtained by obtaining the peak area ratio for the highest-content ester compound with respect to the sum of all the peak areas.

Compound identification can be performed by separately injecting ester waxes of known structure and comparing the same elution times with each other or by introducing the volatilized component into a mass spectrometer and carrying out spectrum analysis.

(Measurement Conditions for MALDI TOF MASS)

Measurement of the composition distribution of the ester wax by MALDI TOF MASS is described in the following. With regard to matrix selection, an optimal matrix was selected in accordance with the analyte species and consideration was given to avoiding overlap between the peaks from the matrix and the peaks from the analyte.

Of the peaks obtained by MALDI TOF MASS, the peaks contained in the aforementioned "range of the molecular weight distribution of the ester wax" are elucidated and the sum of the individual peak intensities is calculated. Among these peaks, the peak with the greatest intensity is taken to be the peak originating from the highest-content ester compound. The proportion of the highest-content ester compound in the composition distribution of the ester wax is calculated as the ratio of the peak intensity originating from the highest-content ester compound to the sum of the peak intensities.

Compound identification can be carried out by analysis of the spectra obtained by MALDI TOF MASS for separate ester waxes of known structure.

<Measurement of the Glass Transition Temperature of the Resins>

The glass transit ion temperature (Tg) of the resins, e.g., the binder resin and so forth, is measured according to ASTM D 3418-82 using a "Q1000" differential scanning calorimeter (from TA Instruments).

Temperature correction in the instrument detection section is carried out using the melting points of indium and zinc, and correction of the amount of heat is carried out using the heat of fusion of indium.

Specifically, 3.0 mg of the resin is precisely weighed out as the a measurement sample.

This is introduced into an aluminum pan and, using an empty aluminum pan for reference, the measurement is carried out under normal humidity at a ramp rate of 10° C./minute in the measurement temperature range between 30° C. and 200° C.

The change in the specific heat in the temperature range of 40° C. to 100° C. is obtained during this heating process. The glass transition temperature (Tg) is taken to be the point at the intersection between the differential heat curve and the line for the midpoint of the baselines for prior to and subsequent to the appearance of the change in the specific heat.

<Method for Observing the Ruthenium-Stained Toner Cross Section with a Scanning Transmission Electron Microscope (STEM)>

Observation of the cross section of the toner with a scanning transmission electron microscope (STEM) can be performed as follows.

Observation of the toner cross section is carried out by ruthenium staining of the toner cross section. The crystalline material present in the toner of the present invention is more easily stained by ruthenium than is the amorphous resin, such as the binder resin, and due to this a clear contrast is obtained and observation is easily performed. The amount of the ruthenium atom changes as a function of the strength/weakness of staining, and as a result these atoms are present in large amounts in a strongly stained region and transmission of the electron beam then does not occur and black appears in the observed image. The electron beam is readily transmitted in weakly stained regions, which then appear in white on the observed image.

First, the toner is dispersed onto a cover glass (Matsunami Glass Ind., Ltd., Square Cover Glass No. 1) so as to provide a single layer, and an Os film (5 nm) and a naphthalene film (20 nm) are formed as protective films using an osmium plasma coater (OPC80T, Filgen, Inc.). Then, D800 photocurable resin (JEOL Ltd.) is filled into a PTFE tube (1.5 mmΦ×3 mmΦ×3 mm) and the cover glass, oriented so the toner is in contact with the D800 photocurable resin, is gently placed over the tube. Exposure to light is carried out while in this configuration and the resin is cured, after which the cover glass is removed from the tube to give a cylindrical resin having the toner embedded in the surfacemost layer. Using an ultrasound ultramicrotome (UC7, Leica Biosystems), the toner cross section is exposed by slicing just the length of the radius of the toner (4.0 μm when the weight-average particle diameter (D4) is 8.0 μm) from the surfacemost face of the cylindrical resin at a slicing rate of 0.6 mm/second. Slicing is then carried out at a film thickness of 250 nm to produce a thin-slice sample of the toner cross section. A cross section of the central region of the toner can be obtained by executing slicing in accordance with this procedure.

Using a vacuum electronic staining device (VSC4R1H, Filgen, Inc.), the obtained thin-slice samples were stained for 15 minutes in a 500 Pa $RuO_4$ gas atmosphere, and STEM observation was carried out using the STEM function of a TEM (JEM2800, JEOL Ltd.).

Image acquisition was carried out at a STEM probe size of 1 nm and an image size of 1,024×1,024 pixels. Image acquisition was performed with the Contrast adjusted to 1,425 and the Brightness adjusted to 3,750 on the Detector Control panel for the bright-field image and with the Contrast adjusted to 0.0, the Brightness adjusted to 0.5, and the Gamma adjusted to 1.00 on the Image Control panel.

<Identification of the Crystalline Material Domains>

The crystalline material domains are identified using the following procedure based on the STEM images of the toner cross section.

When the crystalline material can be acquired as the raw material, their crystalline structures are observed proceeding as in the previously described method for observing the ruthenium-stained toner cross section with a scanning transmission electron microscope (STEM), and an image of the lamellar structure of the crystals of each raw material is obtained. These are compared with the lamellar structure of the domains in the toner cross section, and the raw material forming the domains in the toner cross section can be identified when the error on the interlayer spacing of the lamellae is not more than 10%.

(Isolation of the Crystalline Material)

The following isolation process is carried out when the raw material for the crystalline material cannot be acquired. First, the toner is dispersed in ethanol, which is a poor solvent for the toner, and heating is carried out to a temperature greater than the melting point of the crystalline material. Pressure may be applied at this time as required. At this point, the crystalline material that is above its melting point undergoes melting. After this, a crystalline material mixture can be recovered from the toner by carrying out solid-liquid separation. The crystalline material can be isolated by subjecting this mixture to fractionation into each molecular weight.

<Analysis of the Crystallization Peak Temperature and the Exothermic Curve of the Crystalline Material>

For example, a DSC-7 from PerkinElmer Co., Ltd., a DSC2920 from TA Instruments, or a Q1000 from TA Instruments can be used for the crystallization peak temperature and exothermic curve of the crystalline material. Temperature correction in the instrument detection section uses the melting points of indium and zinc, and correction of the amount of heat uses the heat of fusion of indium. An aluminum pan is used for the measurement sample, and measurement is carried out with the installation of an empty pan for reference. 1.00 mg of the crystalline material is exactly weighed out and is placed in the pan. The measurement conditions are as follows.

measurement mode: Standard ramp up condition: heating from 20° C. to 100° C. at 10° C./minute ramp down condition: cooling from 100° C. to 20° C. at 10° C./minute A temperature-heat flow graph is constructed based on the obtained results, and the exothermic curve for the crystalline material is obtained from the results during cooling. The top of the exothermic peak in the exothermic curve is taken to be the crystallization peak temperature (crystallization temperature) Tc (° C.) The crystallization peak temperature and exothermic curve for the crystalline material can also be obtained from the toner. In the procedure for this, the crystalline material is isolated from the toner and each are then analyzed by DSC.

<Measurement of the Long Axis R of the Toner and the Long Axis r of the Domains A and B of the Crystalline Material>

The long axis R of the toner and the long axis of the domains A and B of the crystalline material are measured as follows in the present invention.

r is designated to be the longest axis of a crystalline material domain based on the STEM image obtained by observation of the ruthenium-stained toner cross section with a scanning transmission electron microscope (STEM). The toner cross sections used for the measurement are toner cross sections that exhibit a long axis R (run) that satisfies the relationship $0.9 \leq R/D4 \leq 1.1$ with respect to the weight-average particle diameter (D4).

The long axis R of the toner is measured on the toner cross sections selected in this manner, and the number average diameter. $R^{Avg}$ is calculated for 100 cross sections.

In addition, the domains B (small domains) are designated to be the domains that, relative to the long axis R of the one selected toner cross section, are contained in that toner cross section and have a long axis r (μm) that satisfies $0.000625 \leq r/R \leq 0.0625$, while the domains A (large domains) are designated to be the domains that, relative to the long axis R of the one selected toner cross section, are contained in that toner cross section and have a long axis r (μm) that satisfies $0.125 \leq r/R \leq 0.375$.

In addition, the proportion (number %) of the toner in which both domain A and domain B are present is calculated for the aforementioned 100 cross sections.

<Measurement of the Number of Crystalline Material Domains B>

The number of domains B (small domains) that exhibit $0.000625 \leq r/R \leq 0.0625$ for the long axis r (μm) and are contained per cross section image of one toner is calculated proceeding in the same manner as for the previously described measurement of the long axis of the crystalline material domains A and B. This is performed on at least 100 toner cross sections, and the arithmetic average value thereof is taken to be the number of crystalline material domains B per toner cross section of one toner.

<Measurement of the Aspect Ratio of the Crystalline Material Domain B>

Proceeding in the same manner as for the previously described measurement of the long axis of the crystalline material domain A and domain B, the longest axis r (μm) and the shortest axis r' (μm) are measured for the crystalline material domains B contained in a toner cross section and the arithmetic average value of r'/r is calculated. This is performed on at least 100 toner cross sections, and the arithmetic value of this at least 100 is designated the aspect ratio of the domain B.

The present invention can provide a toner that exhibits an excellent paper back end rubbing performance during initial image output and that provides, in particular even during long-term use in a low-temperature, low-humidity environment, a stable image density and an excellent, fogging-free image.

EXAMPLES

The present invention is specifically described by the following production examples and examples, but these in no way limit the present invention. Unless specifically indicated otherwise, the number of parts in the following mixtures are on a mass basis in all instances.

Magnetic Iron Oxide Production Example 55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/minute to obtain a slurry that contained core particles.

The obtained slurry was filtered and washed on a filter press, after which the core particles were reslurried by redispersion in water. To this reslurry liquid was added sodium silicate to provide 0.20 mass % as silicon per 100 parts of the core particles; the pH of the slurry was adjusted to 6.0; and magnetic iron oxide particles having a silicon-rich surface were obtained by stirring. The obtained slurry was filtered and washed with a filter press and was reslurried with deionized water. Into this reslurry liquid (solids fraction=50 g/L) was introduced 500 g (10 mass % relative to the magnetic iron oxide) of the ion-exchange resin SK110 (from Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average diameter of 0.23 μm.

<Silane Compound Production>

30 parts of isobutyltrimethoxysilane was added dropwise to 70 parts of deionized water while stirring. While holding this aqueous solution at pH 5.5 and a temperature of 55° C., hydrolysis was then carried out by dispersing for 120 minutes using a dispersing impeller at a peripheral velocity of 0.46 m/second. This was followed by bringing the pH of the aqueous solution to 7.0 and cooling to 10° C. to stop the hydrolysis reaction. A silane compound-containing aqueous solution was obtained proceeding in this manner.

Colorant 1 Production Example 100 parts of the magnetic iron oxide was introduced into a high-speed mixer (Model LFS-2 from Fukae Powtec Corporation) and 8.0 parts of the silane compound-containing aqueous solution was added dropwise over 2 minutes while stirring at a rotation rate of 20.0 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a colorant 1.

<Ester Compound 1 Production>

300 parts by mole of benzene, 200 parts by mole of eicosanol as the alcohol monomer, and 100 parts by mole of decanedioic acid (sebacic acid) as the acid monomer were introduced into a reactor fitted with a Dimroth, a Dean-Stark water separator, and a thermometer. 10 parts by mole of p-toluenesulfonic acid was additionally added and thorough stirring was performed to effect dissolution; this was followed by heating under reflux for 6 hours; and subsequent to this the valve on the water separator was opened and azeotropic distillation was carried out. After the azeotropic distillation, thorough washing was performed with sodium bicarbonate followed by drying and removal of the benzene by distillation. The obtained product was recrystallized followed by washing and purification to obtain an ester compound 1.

<Production of Ester Compounds 2 to 4>

Ester compounds 2 to 4 were obtained proceeding as in Ester Compound 1 Production, but using the acid monomers and alcohol monomers indicated in Table 1.

TABLE 1

| Ester compound | Acid monomer | Alcohol monomer |
|---|---|---|
| Ester compound 1 | Sebacic acid | Eicosanol |
| Ester compound 2 | Sebacic acid | Docosanol |
| Ester compound 3 | Sebacic acid | Tetracosanol |
| Ester compound 4 | Behenic acid | Docosanol |

<Wax 1 Production>

Ester compounds 1 to 3 were melt-mixed in the proportions indicated in Table 2 followed by cooling and then pulverization to obtain a wax 1. The composition proportions measured by GC-MASS (in the table, the proportion and description of the most abundant component) and the crystallization peak temperature Tc are given in Table 2.

<Production of Waxes 2 to 4>

Waxes 2 to 4 were obtained proceeding as in Wax 1 Production, but changing to the proportions indicated in Table 2. The properties of the obtained waxes 2 to 4 are given in Table 2.

<Wax 5>

A commercial hydrocarbon wax was used. The properties of this wax are given in Table 2.

TABLE 2

| | Mixing ratio | | | | | | Crystallization | |
|---|---|---|---|---|---|---|---|---|
| | Component 1 | | Component 2 | | Component 3 | | peak | Proportion of |
| Wax No. | Designation | Blending ratio | Designation | Blending ratio | Designation | Blending ratio | temperature (° C.) | most abundant component (%) |
| 1 | Ester compound 1 | 15 | Ester compound 2 | 70 | Ester compound 3 | 15 | 75 | 70 |
| 2 | Ester compound 1 | 35 | Ester compound 2 | 30 | Ester compound 3 | 35 | 75 | 35 |
| 3 | Ester compound 1 | 9 | Ester compound 2 | 82 | Ester compound 3 | 9 | 75 | 82 |
| 4 | Ester compound 4 | 100 | — | — | — | — | | 100 |
| 5 | Hydrocarbon wax | 100 | — | — | — | — | | 100 |

<Production of Toner 1>

450 parts of a 0.1 mol/L aqueous $Na_3PO_4$ solution was introduced into 720 parts of deionized water and the temperature was raised to 60° C.; this was followed by the addition of 67.7 parts of a 2.0 mol/L aqueous $CaCl_2$ solution to obtain an aqueous medium containing a dispersion stabilizer.

| | |
|---|---|
| styrene | 75.0 parts |
| n-butyl acrylate | 25.0 parts |
| divinylbenzene | 0.55 parts |
| iron complex of a monoazo dye (T-77: from Hodogaya Chemical Co., Ltd.) | 1.0 part |
| colorant 1 | 90.0 parts |

This formulation was dispersed and mixed to uniformity using an attritor (Mitsui Miike Chemical Engineering Machinery Co. Ltd.) to obtain a monomer composition. This monomer composition was heated to 63° C., and to this was added 15 parts of the wax 1 indicated in Table 2 as the ester wax with mixing and dissolution. 9.0 parts of the polymerization initiator tert-butyl peroxypivalate was then dissolved.

This monomer composition was introduced into the aforementioned aqueous medium and stirring was performed for 10 minutes at 12,000 rpm with a TK Homomixer (Tokushu Kika Kogyo Co., Ltd.) at 60° C. and under an $N_2$ atmosphere to effect granulation. Then, while stirring with a paddle stirring blade, a reaction was run for 4 hours at 70° C. After the completion of the reaction, the temperature of the aqueous medium, which was a suspension, was raised to 90° C. and holding was carried out for 30 minutes.

After this, as the cooling step (i), 5° C. water was introduced into the aqueous medium and cooling was performed from 90° C. to 50° C. at a cooling rate of 135.00° C./minute. Then, as the cooling step (ii), holding was carried out for 2 hours at 50° C.±5° C. followed by cooling to 30° C. Hydrochloric acid was subsequently added to the aqueous medium, and washing and then filtration and drying yielded a toner particle 1.

A toner 1 was thereafter obtained by mixing, using a Henschel mixer (Mitsui Miike Chemical Engineering Machinery Co., Ltd.), 100 parts of the toner particle 1 with 0.8 parts of hydrophobic silica fine particles having a BET value of 300 $m^2/g$ and a primary particle diameter of 8 nm. The content of the styrene-acrylic resin in the binder resin was 100 mass % in the obtained toner 1. The glass transition temperature Tg of the toner was 50° C. The properties of toner 1 are given in Table 4.

<Production of Toners 2 to 16 and Comparative Toners 1 to 7>

Toners 2 to 16 and comparative toners 1 to 7 were produced proceeding as in Production of Toner 1, but changing the type of crystalline material, the amount of addition of the crystalline material, the cooling rate in the cooling step, and the holding time as indicated in Table 3. The properties are given in Table 4.

TABLE 3

| Toner No. | Crystalline material designation | Number of parts of crystalline material addition | Cooling rate (° C./minute) | Holding time (h) |
|---|---|---|---|---|
| 1 | Wax 1 | 15 | 135 | 2 |
| 2 | Wax 1 | 10 | 135 | 2 |
| 3 | Wax 5 | 10 | 135 | 2 |
| 4 | Wax 2 | 10 | 135 | 2 |
| 5 | Wax 3 | 10 | 135 | 2 |
| 6 | Wax 4 | 10 | 135 | 2 |
| 7 | Wax 4 | 25 | 135 | 2 |
| 8 | Wax 4 | 5 | 135 | 2 |
| 9 | Wax 4 | 10 | 135 | 5 |
| 10 | Wax 4 | 10 | 135 | 0 |
| 11 | Wax 4 | 10 | 210 | 0.5 |
| 12 | Wax 4 | 10 | 5 | 2 |
| 13 | Wax 4 | 25 | 5 | 5 |
| 14 | Wax 4 | 10 | 5 | 0.2 |
| 15 | Wax 4 | 10 | 135 | 0 |
| 16 | Wax 4 | 5 | 5 | 0 |
| Comparative 1 | Wax 1 | 10 | 0.1 | 0 |
| Comparative 2 | Wax 1 | 10 | 3 | 0 |
| Comparative 3 | Wax 1 | 15 | 420 | 0 |
| Comparative 4 | Wax 1 | 3 | 90 | 5 |
| Comparative 5 | Wax 1 | 35 | 90 | 2 |
| Comparative 6 | Wax 1 | 10 | 0.1 | 2 |
| Comparative 7 | Wax 1 | 5 | 420 | 0 |

In the table, the cooling rate is the cooling rate from 90° C. to 50° C. In addition, the holding time indicates the holding time at 50° C.±5° C. in cooling step (ii).

<Production of Comparative Toner 8>

<Synthesis of Low Molecular Weight Polyester 1>

The following starting materials were charged to a heat-dried two-neck flask while introducing nitrogen.

2 mol adduct of ethylene oxide on bisphenol A: 229 parts
3 mol adduct of propylene oxide on bisphenol A: 529 parts
terephthalic acid: 208 parts
adipic acid: 46 parts
dibutyltin oxide: 2 parts The interior of the system was replaced with nitrogen by a reduced pressure procedure followed by stirring for 5 hours at 215° C. Then, while continuing to stir, the temperature was gradually raised to 230° C. under reduced pressure; holding for 3 hours was carried out; and 44 parts of trimellitic anhydride was then added to the two-neck flask and a reaction was run for two hours at normal pressure and 180° C. to obtain [low molecular weight polyester 1].

<Production of Crystalline Material Dispersion 1> low molecular weight carnauba wax (melting point=82° C.): 5 parts
low molecular weight polyester resin 1: 25 parts
ethyl acetate: 67.5 parts
deionized water: 200.0 parts The preceding were mixed; 3 mm zirconia was added at a 60% volume ratio; and, using a Model No. 5400 Paint Conditioner (from Red Devil Equipment Co., (USA)), dispersion was carried out until a weight-average particle diameter (D4) of 400 nm was reached, thus yielding crystalline material dispersion 1.

<Production of Crystalline Material Dispersion 2>

Proceeding as in Production of Crystalline Material Dispersion 1 but changing the low molecular weight carnauba wax to ester compound 1 (2.5 parts), production was carried out until a weight-average particle diameter (D4) of 1.5 μm was reached.

<Synthesis of Amorphous Resin 1>

The following starting materials were charged to a heat-dried two-neck flask while introducing nitrogen.

| | |
|---|---|
| polyoxypropylene(2.2)-2,2-bis(4-hydroxyphenyl)propane | 30 parts |
| polyoxyethylene(2.2)-2,2-bis(4-hydroxyphenyl)propane | 34 parts |
| terephthalic acid | 30 parts |
| fumaric acid | 6.0 parts |
| dibutyltin oxide | 0.1 parts |

The interior of the system was replaced with nitrogen by a reduced pressure procedure followed by stirring for 5 hours at 215° C. Then, while continuing to stir, the temperature was gradually raised to 230° C. under reduced pressure and holding was carried out for 2 hours. When a viscous state had been assumed, air cooling was performed and the reaction was stopped to yield an amorphous resin 1, which was an amorphous polyester.

<Production of Amorphous Resin Dispersion>

50.0 parts of amorphous resin 1 was dissolved in 200.0 parts of ethyl acetate and 3.0 parts of an anionic surfactant (sodium dodecylbenzenesulfonate) was added along with 200.0 parts of deionized water. Heating to 40° C. was performed; stirring for 10 minutes at 8,000 rpm was carried out using an emulsifying device (Ultra-Turrax T-50, from IKA Japan K.K.); and the ethylene acetate was evaporatively removed to obtain an amorphous resin dispersion.

<Production of Colorant Dispersion> colorant 1: 50.0 parts
Neogen RK cationic surfactant (DKS Co. Ltd.): 5.0 parts
deionized water: 200.0 parts These materials were introduced into a heat-resistant glass container; dispersion was performed for 5 hours with a paint shaker; and the glass beads were removed using a nylon mesh to obtain a colorant dispersion having a solids fraction of 20 mass % and a volume-based median diameter (D50) of 220 nm.

(Production Process for Comparative Toner Particle 8)

the colorant dispersion: 25.0 parts
crystalline material dispersion 1: 30.0 parts
crystalline material dispersion 2: 30.0 parts
10 mass % aqueous solution of polyaluminum chloride: 1.5 parts The preceding were mixed in a round stainless steel flask and were mixed and dispersed using an Ultra-Turrax T-50 from IKA Japan K.K.; this was followed by holding for 60 minutes at 45° C. while stirring (aggregation step). 50 parts of the amorphous resin dispersion was then slowly added; the pH of the system was brought to 6 using a 0.5 mol/L aqueous sodium hydroxide solution; the stainless steel flask was then sealed; and, while continuing to stir using a magnetic seal, heating to 96° C. was carried out. During the temperature increase, supplemental additions of the aqueous sodium hydroxide solution were made in order to prevent the pH from going below 5.5. This was followed by holding for 5 hours at 96° C. (fusion step).

Cooling, filtration, and thorough washing with deionized water were subsequently performed and solid-liquid separation was then carried out using suction filtration across a nutsch filter. This was redispersed using an additional 3 L of deionized water, and stirring and washing were performed at 300 rpm for 15 minutes. This was repeated an additional 5 times, and, when the pH of the filtrate reached 7.0, solid-liquid separation was carried out using filter paper by suction filtration across a nutsch filter. Vacuum drying was then continued for 12 hours to obtain a comparative toner particle 8.

A comparative toner 8 was thereafter obtained by mixing, using a Henschel mixer (Mitsui Miike Chemical Engineering Machinery Co., Ltd.), 100 parts of the comparative toner particle 8 with 0.8 parts of hydrophobic silica fine particles having a BET value of 300 $m^2/g$ and a primary particle diameter of 8 nm. The properties of comparative toner 8 are given in Table 4.

TABLE 4

| Toner particle No. | $R^{Avg}$ (μm) | Average value of r/R for domain A | Average value of r/R for domain B | Proportion of toner in which domains A and B are present (number %) | Number of domains B | Aspect ratio for domain B | Toner Tg (° C.) |
|---|---|---|---|---|---|---|---|
| 1 | 7.8 | 0.300 | 0.030625 | 92 | 155 | 0.91 | 50 |
| 2 | 7.9 | 0.239 | 0.032000 | 85 | 144 | 0.91 | 50 |
| 3 | 7.9 | 0.254 | 0.028875 | 86 | 98 | 0.21 | 50 |
| 4 | 7.9 | 0.247 | 0.031750 | 82 | 114 | 0.72 | 50 |
| 5 | 7.8 | 0.249 | 0.024750 | 88 | 125 | 0.68 | 50 |
| 6 | 8.0 | 0.254 | 0.027500 | 89 | 114 | 0.75 | 50 |

TABLE 4-continued

| Toner particle No. | $R^{Avg}$ (μm) | Average value of r/R for domain A | Average value of r/R for domain B | Proportion of toner in which domains A and B are present (number %) | Number of domains B | Aspect ratio for domain B | Toner Tg (° C.) |
|---|---|---|---|---|---|---|---|
| 7 | 7.9 | 0.340 | 0.032375 | 95 | 125 | 0.66 | 50 |
| 8 | 7.9 | 0.146 | 0.029375 | 75 | 130 | 0.79 | 50 |
| 9 | 7.8 | 0.247 | 0.058875 | 85 | 44 | 0.67 | 50 |
| 10 | 8.0 | 0.283 | 0.001875 | 86 | 124 | 0.79 | 50 |
| 11 | 8.0 | 0.185 | 0.002250 | 84 | 248 | 0.77 | 51 |
| 12 | 7.8 | 0.259 | 0.029375 | 88 | 23 | 0.72 | 49 |
| 13 | 7.9 | 0.342 | 0.058750 | 91 | 24 | 0.71 | 49 |
| 14 | 7.9 | 0.246 | 0.001500 | 85 | 22 | 0.68 | 49 |
| 15 | 8.1 | 0.150 | 0.002125 | 84 | 284 | 0.71 | 50 |
| 16 | 8.2 | 0.138 | 0.000994 | 75 | 28 | 0.72 | 49 |
| Comparative 1 | 7.9 | 0.244 | 0.000000 | 0 | 0 | — | 49 |
| Comparative 2 | 8.2 | 0.248 | 0.002250 | 55 | 11 | 0.88 | 49 |
| Comparative 3 | 7.8 | 0.262 | 0.001750 | 80 | 342 | 0.85 | 52 |
| Comparative 4 | 8.1 | — (0.101) | 0.024750 | 0 | 28 | 0.86 | 50 |
| Comparative 5 | 8.0 | — (0.407) | 0.017750 | 0 | 46 | 0.88 | 50 |
| Comparative 6 | 8.0 | 0.249 | 0.018125 | 32 | 3 | 0.78 | 49 |
| Comparative 7 | 8.0 | 0.162 | — (0.000325) | 0 | — (52) | — (0.65) | 52 |
| Comparative 8 | 8.0 | 0.172 | 0.039750 | 95 | 8 | 0.48 | 50 |

Domains satisfying the domain A condition were not present in comparative toner particles 4 and 5. The results for the domains that did not satisfy the domain A condition are given in parentheses in the column at comparative toner particles 4 and 5.

Similarly, domains satisfying the domain B condition were not present in comparative toner particle 7. The results for the domains that did not satisfy the domain B condition are given in parentheses in the column at comparative toner particle 7.

Example 1

A modified LBP3100 printer from Canon Inc. was used for the image output evaluations. The modifications were as follows: the process speed was made 200 mm/second, which was faster than the pre-existing process speed; the contact pressure between the fixing film and the pressure roller was modified to 69 kg·m/second, thus providing a light pressure. The modified LBP3100 was also modified to enable adjustment of the fixation temperature at the fixing unit.

300 g of toner 1 was filled into this modified machine and fixing was evaluated as described below in a normal-temperature, normal-humidity environment (temperature=25° C., relative humidity=50% RH).

After this, an image output test was conducted in which 4,000 prints of horizontal lines with a print percentage of 1% were made in a 2 print/6 second intermittent mode in a low-temperature, low-humidity environment (temperature=15° C., relative humidity=10% RH).

<Evaluation of Fixing>

A rubbing test was performed in a normal-temperature, normal-humiity environment (temperature=25.0° C., humidity=50% RH) using the image-forming apparatus described above. The evaluation of fixing (rubbing test) indicated above is performed prior to the 4,000-print image output test. Fox River Bond paper (110 g/m$^2$) was used for the fixing media. By using a media that is a thick paper and that presents relatively large surface asperities, a rigorous evaluation of the fixing performance can be carried out by establishing conditions that facilitate peeling and facilitate rubbing.

(Rubbing Test)

Image output was carried out, in the aforementioned normal-temperature, normal-humidity environment, with adjustment of the halftone image density to provide an image density (measured using a MacBeth reflection densitometer (from GretagMacBeth)) on the fixing media of at least 0.75 and not more than 0.80.

After this, the fixed halftone image was rubbed 10 times with lens-cleaning paper carrying a load of 55 g/cm$^2$. The halftone image density was measured at 5 points both before and after the rubbing, and the average value of the density decline at 150° C. was calculated using the following formula.

density decline=(image density before rubbing−image density after rubbing)/image density before rubbinrg×100(%)

Figure 2:
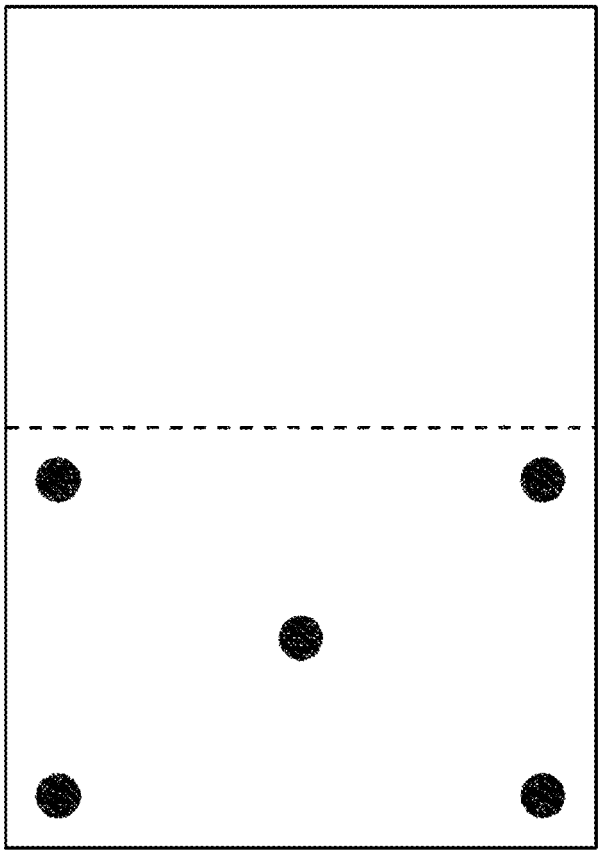
FIG. 2 is a diagram of a region for measuring image density.

With regard to the 5 points where the image density is measured, and designating the surface where the media first passes through the fixing unit as the front end and designating the surface where it passes last as the back end, the points as shown in FIG. 2 are measured between the middle of the media and the back end.

Proceeding similarly, the fixation temperature was raised in 5° C. increments and the density decline was similarly calculated up to and including 200° C. Using the fixation temperatures and the results of the evaluation of the density decline obtained in this series of operations, the temperature was calculated at which the density decline became 15%, and this temperature was taken to be the fixation temperature indicating the threshold value at which the low-temperature fixability was excellent. For this temperature calculation, a graph was constructed from the temperature (vertical axis) and the density decline (horizontal axis), and the temperature was used at the intersection between a 15% density decline and the line segment for the two temperature points that straddled the 15% density decline.

A: the lower temperature limit for fixing is less than 160° C.

B: the lower temperature limit for fixing is at least 160° C. and less than 170° C.

C: the lower temperature limit for fixing is at least 170° C. and less than 180° C.

D: the lower temperature limit for fixing is at least 180° C.

<Evaluation of the On-Drum Fogging after Durability Testing>

After the completion of image output in the low-temperature, low-humidity environment as described above, an evaluation of fogging was performed in the same environment. The fogging was measured using a Model TC-6DS Reflectometer from Tokyo Denshoku Co., Ltd. A green filter was used for the filter. The on-drum fogging was calculated as follows: a solid black image was output; after the solid black image had been transferred, mylar tape was taped onto a non-image area on the photosensitive drum; and the on-drum fogging was calculated by subtracting, from the reflectance for the mylar tape pasted on paper, the MacBeth density of unused mylar tape pasted on paper. For the present invention, a rank of C or better represents a level at which the effects of the present invention have been obtained.

fogging (reflectance) (%)=reflectance (%) of the non-image area sample−reflectance (%) on standard paper A: less than 5%
B: at least 5% and less than 10%
C: at least 10% and less than 20%
D: at least 20%

<Evaluation of the Image Density after Durability Testing>

After the completion of image output in the low-temperature, low-humidity environment described above, the image density was evaluated in the same environment. The image density was obtained by forming a solid black image area and then measuring the density of this solid black image using a MacBeth reflection densitometer (from GretagMacBeth). The evaluation criteria for the reflection density of the solid black image are given below. For the present invention, a rank of C or better represents a level at which the effects of the present invention have been obtained.

A: at least 1.46
B: at least 1.41 and not more than 1.45
C: at least 1.36 and not more than 1.40
D: not more than 1.35

Examples 2 to 16 and Comparative Examples 1 to 8

The evaluations were performed as in Example 1, but using toners 2 to 16 and comparative toners 1 to 8. The results of the evaluations are given in Table 5.

TABLE 5

| | Toner particle No. | Rubbing (° C.) | Fogging after durability testing | Image density after durability testing |
|---|---|---|---|---|
| Example 1 | 1 | A (153) | A (3) | A (1.48) |
| Example 2 | 2 | A (155) | A (2) | A (1.47) |
| Example 3 | 3 | A (158) | B (5) | A (1.47) |
| Example 4 | 4 | B (162) | B (6) | A (1.46) |
| Example 5 | 5 | B (165) | B (7) | A (1.47) |
| Example 6 | 6 | B (164) | B (6) | B (1.42) |
| Example 7 | 7 | C (172) | B (6) | B (1.45) |
| Example 8 | 8 | C (171) | B (8) | B (1.43) |
| Example 9 | 9 | B (164) | B (8) | C (1.38) |
| Example 10 | 10 | B (168) | B (8) | C (1.37) |
| Example 11 | 11 | B (165) | C (11) | B (1.42) |
| Example 12 | 12 | B (166) | C (13) | B (1.41) |
| Example 13 | 13 | B (168) | C (16) | C (1.40) |
| Example 14 | 14 | B (166) | C (15) | C (1.38) |
| Example 15 | 15 | C (174) | C (18) | B (1.43) |
| Example 16 | 16 | C (175) | C (19) | B (1.41) |
| Comparative Example 1 | Comparative 1 | C (173) | D (22) | D (1.33) |
| Comparative Example 2 | Comparative 2 | C (178) | D (22) | C (1.37) |
| Comparative Example 3 | Comparative 3 | C (176) | D (24) | D (1.33) |
| Comparative Example 4 | Comparative 4 | D (181) | C (18) | C (1.36) |
| Comparative Example 5 | Comparative 5 | B (169) | D (24) | D (1.28) |
| Comparative Example 6 | Comparative 6 | C (172) | D (25) | C (1.36) |
| Comparative Example 7 | Comparative 7 | C (171) | D (22) | C (1.36) |
| Comparative Example 8 | Comparative 8 | C (173) | D (30) | D (1.30) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237662, filed Dec. 4, 2015, which is hereby incorporated by reference herein in its entirety.

What is claimed is:

1. A toner comprising a binder resin, a crystalline material and a colorant, said toner providing a domain of the crystalline material in a cross section of the toner observed with a scanning electron microscope, wherein when domain A satisfies $0.125 \leq r/R \leq 0.375$ and domain B satisfies $0.000625 \leq r/R \leq 0.0625$, where r represents a long axis of the domain of the crystalline material and R represents the long axis of the toner, the toner in which the domain A and the domain B are both present is at least 50 number %, the toner satisfies $4\ \mu m \leq R^{Avg} \leq 12\ \mu m$ where $R^{Avg}$ represents the number average diameter of a long axis of the toner, and the number of domain B per cross section image of one toner is 50 to not more than 300.

2. The toner according to claim 1, wherein the crystalline material comprises an ester wax.

3. The toner according to claim 1, wherein an aspect ratio of domain B is from 0.8 to 1.0.

4. The toner according to claim 2, wherein the ester wax comprises an ester compound, and the proportion of the highest-content ester compound relative to a total amount of the ester wax is 40 to 80 mass % in a composition distribution of the ester wax measured by GC-MASS or MALDI TOF MASS.

5. The toner according to claim 2, wherein the ester wax is any of an ester compound from an at least dihydric alcohol and an aliphatic monocarboxylic acid and an ester compound from an at least dibasic carboxylic acid and an aliphatic monoalcohol.

* * * * *